US007520550B2

(12) United States Patent
Lord

(10) Patent No.: US 7,520,550 B2
(45) Date of Patent: Apr. 21, 2009

(54) PLATE CARRIER

(76) Inventor: Andrew Lord, 341 Calle Miramar #D, Redondo Beach, CA (US) 90277

( * ) Notice: Subject to any disclaimer, the term of this patent is extended or adjusted under 35 U.S.C. 154(b) by 0 days.

(21) Appl. No.: 11/301,539

(22) Filed: Dec. 13, 2005

(65) Prior Publication Data

US 2007/0132260 A1 Jun. 14, 2007

(51) Int. Cl.
*A45F 5/00* (2006.01)

(52) U.S. Cl. ..... 294/161; 294/143; 220/914

(58) Field of Classification Search ..... 211/71.01, 211/41.2, 49.1; 294/161, 163, 25, 143, 144; D7/705, 706; 220/23.8, 556, 570, 914; 206/557; 224/219, 222

See application file for complete search history.

(56) References Cited

U.S. PATENT DOCUMENTS

| | | | | |
|---|---|---|---|---|
| 544,055 | A | 8/1895 | Smith | |
| 953,007 | A * | 3/1910 | Haller | 211/71.01 |
| 1,379,379 | A * | 5/1921 | Abrahmsen | 211/41.4 |
| 1,888,141 | A | 11/1932 | Orth | |
| 2,087,375 | A | 7/1937 | Ehrnhardt | |
| 5,062,674 | A * | 11/1991 | Magee | 294/143 |
| 5,064,236 | A | 11/1991 | Stanfield | |
| 5,104,168 | A * | 4/1992 | Magee | 294/143 |
| 5,152,398 | A * | 10/1992 | Forestal et al. | 206/561 |
| 5,542,731 | A | 8/1996 | Wills | |
| D427,026 | S | 6/2000 | Wang | |

FOREIGN PATENT DOCUMENTS

EP 0574101 A1 * 12/1993

* cited by examiner

*Primary Examiner*—Paul T Chin
(74) *Attorney, Agent, or Firm*—Kenneth L. Green; Edgar W. Averill, Jr.

(57) ABSTRACT

A plate carrier is carried on a server's forearm. The carrier comprises a horizontal support portion for carrying the plate carrier on the forearm and a vertical spine with at least one plate holder. The horizontal support resides between the elbow and the palm, and comprises a plastic support surface and a metal backing. The vertical spine extends downwardly from the horizontal support, looping around the forearm, and continuing downward below the server's forearm. The spine is laterally centered on the horizontal support, and longitudinally closer to the elbow than the palm. The plate holders extend longitudinally with respect to the horizontal support, and a majority of the plate holders extend forward from the spine.

20 Claims, 4 Drawing Sheets

PLATE CARRIER

BACKGROUND OF THE INVENTION

The present invention relates to a plate carrier, and more particularly to a plate carrier for use by servers in a restaurant.

Servers at restaurants often prefer to carry a number of plates in each trip between a kitchen and diner's table to minimize the number of trips necessary to provide meals and to clear the tables. Generally, plates are carried on a large tray. Unfortunately, if the server is bumped or stumbles, the plates may fall off the tray, and possibly onto diners.

U.S. Pat. No. 953,007 for "Serving Rack," describes a rack for use by waiters in hotels, restaurants, etc. The rack includes a handle and a vertical member extending down from the handle. A multiplicity of substantially round wire loops reside on opposite sides of the vertical member and are adapted for supporting plates and cups of various sizes. A supporting member resides at the bottom of the vertical member, thus allowing the rack to be placed horizontal surfaces when not being carried by a waiter. Unfortunately, the carrier of the '007 patent requires an awkward hand and arm position, resulting in rapid fatigue of the server. Other plate carriers are known, but they similarly require carrying by the hand, and are also awkward and fatiguing.

BRIEF SUMMARY OF THE INVENTION

The present invention addresses the above and other needs by providing a plate carrier carried on a server's forearm. The carrier comprises a horizontal support portion for carrying the plate carrier on the forearm and a vertical spine with at least one plate holder. The horizontal support resides between the elbow and the palm, and preferably comprises a plastic support surface and a metal backing, but may also be all plastic, all metal, or made from any material providing adequate strength. The vertical spine extends downwardly from horizontal support, looping around the forearm, and continuing downward below the server's forearm. The spine is laterally centered on the horizontal support, and longitudinally closer to the elbow than the palm. The plate holders extend longitudinally with respect to the horizontal support, and a majority of the plate holders extend forward from the spine.

In accordance with one aspect of the invention, there is provided a plate carrier comprising a horizontal support, a spine attached to the horizontal support, and plate holders attached to the spine. The horizontal support has a substantially rectangular shape, resides horizontally, and has a support length of approximately eight inches and support width of approximately 1.5 inches. The spine is attached to the horizontal support and extends downward from the horizontal support. The spine comprises a loop portion below the horizontal support, the loop portion having a height $H_L$ of approximately 4.5 inches and a depth $D_L$ of approximately 1.5 inches, and a plate holder portion below the loop portion. The plate holder portion is approximately laterally centered under the horizontal support. At least one plate holder is attached to the plate holder portion, and the plate holder portion is preferably a vertical segment of the spine and at least two vertically spaced apart plate holders are attached to the plate holder portion.

In accordance with another aspect of the invention, there is provided a plate carrier comprising a horizontal support, a spine, and at least one plate holder. The horizontal support has a substantially rectangular shape, resides horizontally, and has a support length of between approximately two inches and approximately twelve inches and support width of between approximately one inch and approximately two inches. The horizontal support includes a forward end and a rearward end. The spine is attached to the horizontal support proximal to the rearward end and extends downward from the horizontal support. The spine includes a loop portion below the horizontal support, the loop portion having a height $H_L$ of between approximately four inches and approximately five inches and a depth $D_L$ of between approximately 1.5 inches and approximately 2.5 inches. The spine further includes a plate holder portion below the loop portion, which plate holder portion is approximately laterally centered under the horizontal support. At least one plate holder is attached to the plate holder portion and extends forward.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1C:
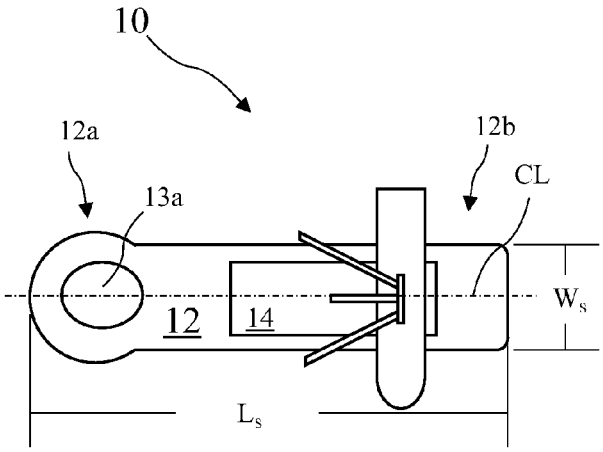
FIG. 1C is a top view of the plate carrier.
Figure 1A:
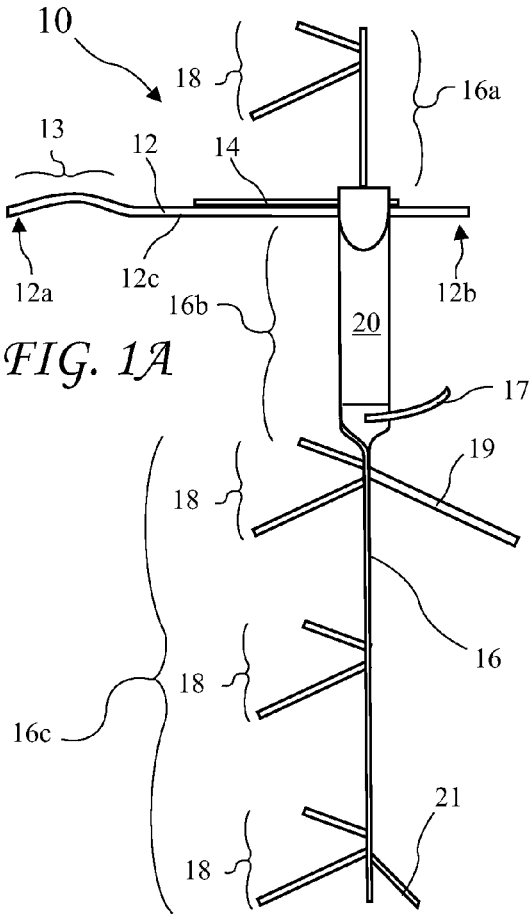
FIG. 1A is a side view of a plate carrier according to the present invention.
Figure 1B:
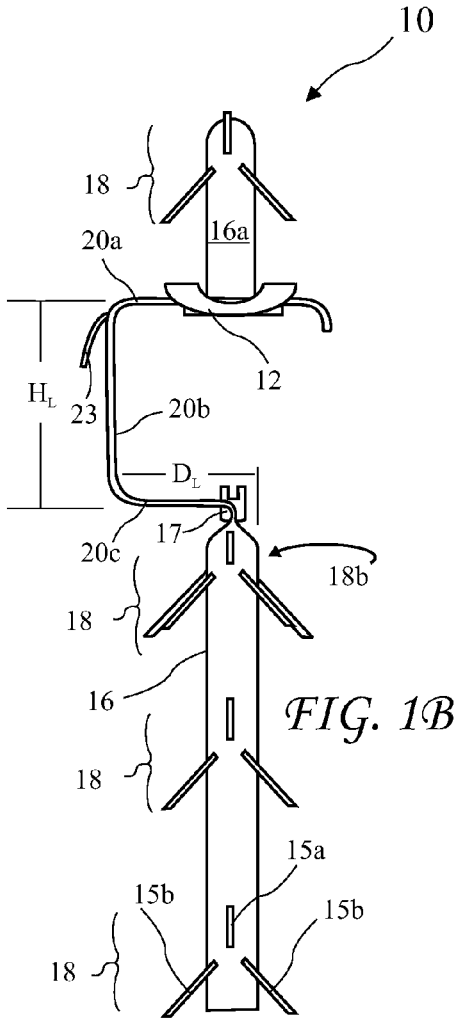
FIG. 1B is a front view of the plate carrier.

A side view of a plate carrier 10 according to the present invention is shown in FIG. 1A, a front view of the plate carrier 10 is shown in FIG. 1B, and a top view of the plate carrier 10 is shown in FIG. 1C. The plate carrier 10 includes a horizontal support 12 and a spine 16. The horizontal support 12 has a length $L_S$ and a width $W_S$. The length $L_S$ is preferably between approximately two inches and approximately twelve inches and more preferably is approximately eight inches. The width $W_S$ is preferably between approximately one inch and approximately two inches, and more preferable approximately 1.5 inches. The plate carrier 10 has a centerline CL which aligns with a server's forearm.

The horizontal support 12 is preferably substantially rectangular with rounded corners and includes a forward (to the left in FIG. 1A) end 12*a* and a rearward end 12*b* opposite the forward end. The horizontal support 12 includes a support surface 12*c* configured to carry on a server's forearm. The support surface preferably includes an upwardly arched portion 13 proximal to the forward end 12*a* to cooperate with (or follow) a server's hand. The upward arched portion 13 is rounded and somewhat resembles a large inverted spoon and includes a thumb hole 13 for the server's thumb. The horizontal support 12 may be made from a flexible or soft material and a support bracket 14 may be attached to the spine 16, and the horizontal support member 12 may be attached to the support bracket 14.

The spine 16 is connected to the horizontal support 12 proximal to the rearward end 12*b*. The spine 16 includes a loop portion 16*b* under the horizontal support 12, which loop portion 16*b* loops around the server's forearm. The spine 16 further includes a plate holder portion 16*c* under the loop portion 16*b*. At least one plate holder 18 is attached to the plate holder portion 16*c* for holding plates, and preferably three forward pointing vertically spaced apart plate holders 18 are attached to the portion 16*c* and pointing forward (to the left in FIG. 1A). The plate holders 18 may be the same size, or may be different sizes for different size plates. The spine 16 may further include a spine upper portion 16*a* extending upward from the horizontal support 12, and having a fourth plate holder 18 attached.

Feet 21 are attached to the spine 16 proximal to the bottom of the spine 16, and extend angled downward from the spine 16 opposite a bottom most plate holder 18. The feet extend downward approximately as far as the bottom of the spine 16. A pepper mill holder 17 is attached to the spine proximal to the top of the plate holder portion 16*c*. The pepper mill holder 17 faced to the rear (right in FIG. 1A) and is forked to cooperate with the pepper mill holder 17. A carrying hook 23 is attached to the spine near the horizontal carrier 12 to allow the place carrier 10 to be hooked over a belt, pocket, and the like to free up the server's arms and/or hands. A pair of stabilizers 19 are attached to the spine 16 proximal to the top of the plate carrier portion 16*c*. The stabilizers 19 may rest against the server's side while carrying the plate carrier 10, or may be hooked or rest on the server's belt, pocket, or the like.

The plate holders 18 may be any structure suitable for holding a plate to the plate carrier 10. For example, each plate holder 18 may comprise three pins extending from the spine 16, and may preferably comprise two downward angled pins 15*b* and one pin is an upward angled pin 15*a*. A plate is inserted between the pins 15*a* and 15*b* to hold the plate. The pins 15*a* and 15*b* may be coated with a latex, a rubber or other sticky material to facilitate holding the plates. Such pins 15*a* and 15*b* advantageously accommodate a variety of plate sizes and shapes. The plate holders may also be wire loops to set plates onto, or solid cupped holders to set plates into, or be spring clamps, or the like.

Figure 2:
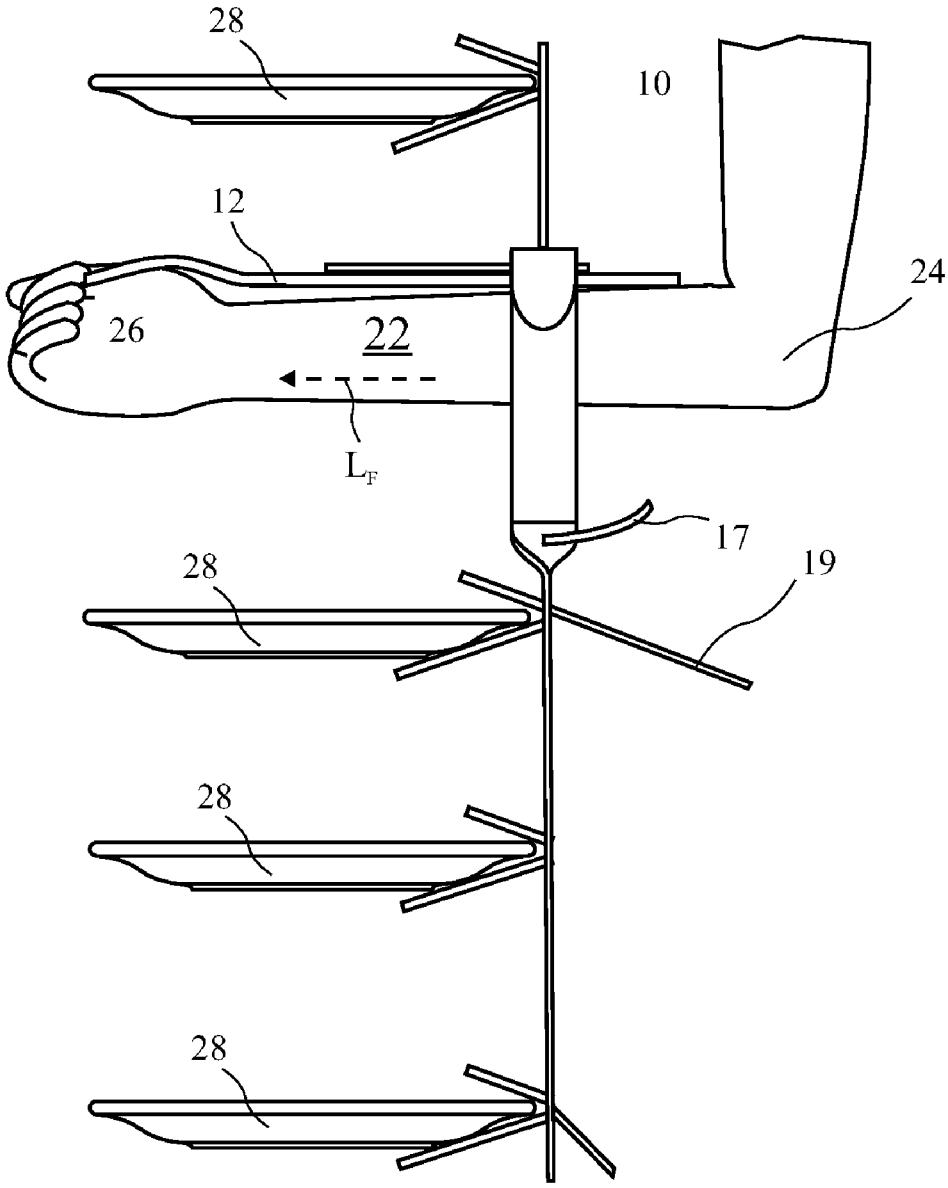
FIG. 2 depicts the plate carrier resting on a forearm and holding plates.

The plate carrier 10 is shown resting on a server's forearm 22 and holding plates 28 in FIG. 2. The length $L_F$ (see FIG. 1C) of the horizontal support 12 is aligned with the centerline CL of the forearm. The horizontal support 12 extends from near the elbow 24 to the hand 26, more or less depending on the forearm length of the server. In the instance of a plate carrier 10 with a short horizontal support 12, the plate carrier 10 may be carried at any position along the forearm, or even by the hand 26. The plates 28 are carried forward (to the left in FIG. 2) of the spine 16, and the spine 16 is attached to the horizontal support 12 toward the rear 12*b* (see FIG. 1A) of the horizontal support 12 to provide for balanced carrying. The server may further insert a thumb or finger through the thumb hole 13*a* (see FIG. 1C) in the forward end 12*a* of the horizontal support 12 to hold the plate carrier 10 more securely.

Figure 3:
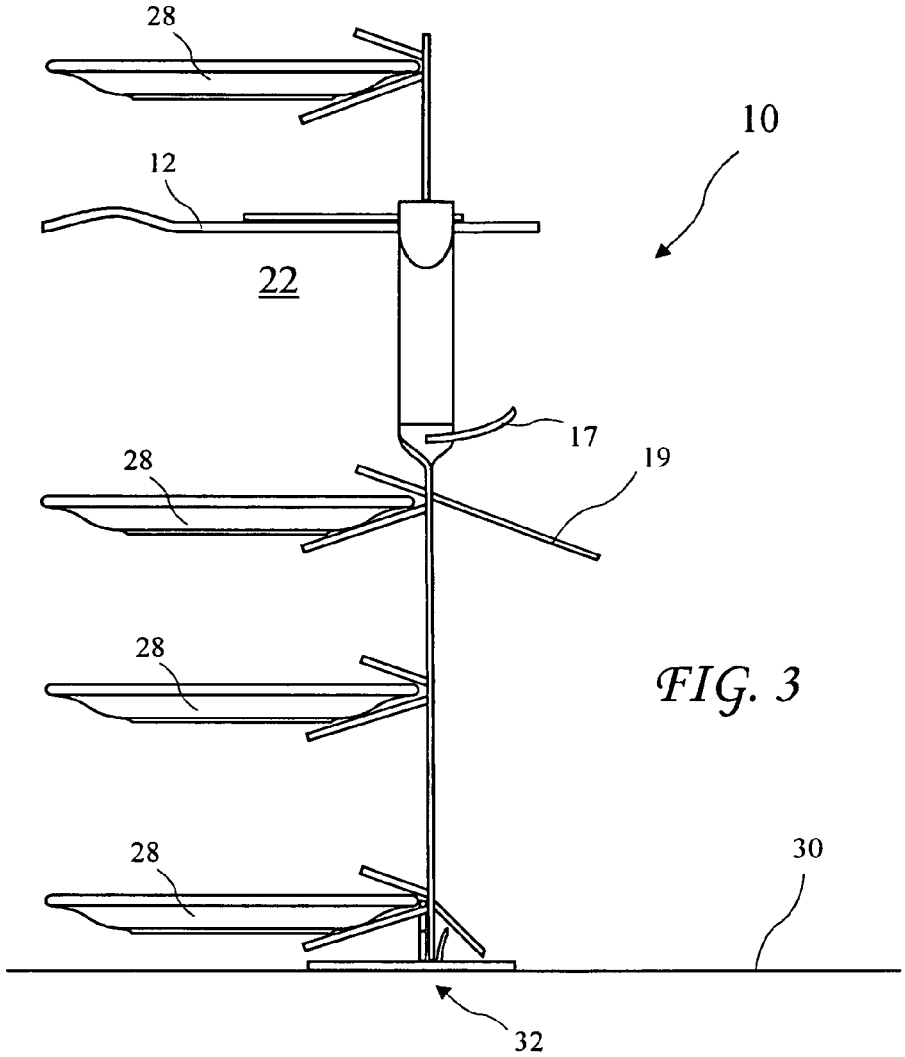
FIG. 3A I a side view of the plate carrier supported by a stand.

The plate carrier 10 may further be supported on a substantially flat surface 30 by the feet 21 and a stand 32 as shown in FIG. 3, wherein the plate carrier 10 is held in a substantially vertical position thereby allowing plates to be held by the plate holders. The plate carrier 10 thus supported may receive plates in preparation for delivery by the server to a table. Because the plates reside in a vertically spaced apart manner on the plate carrier, the kitchen and/or serving area required for the plate carrier is minimized. The plate carrier 10 may alternatively include a flat plate, cone, or rounded base to provide support on a horizontal surface. The plate carrier 10 may further include a downward pointing pin to insert into a receiving hole to support the plate carrier 10, for example, a pin pointing downward from a rounded base.

Figure 4A:
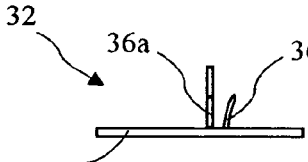
FIG. 4A is a side view of the stand for the plate carrier.
Figure 4B:
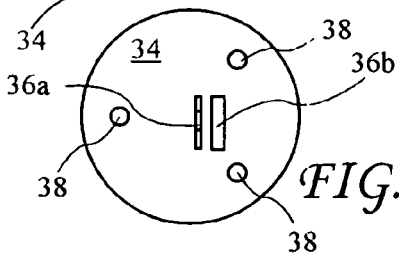
FIG. 4B is a top view of the stand for the plate carrier.
Figure 4C:
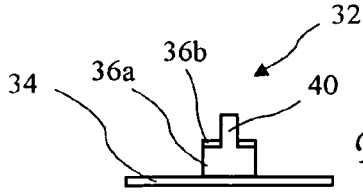
FIG. 4C is an front view of the stand for the plate carrier.

A detailed side view of the stand 32 is shown in FIG. 4A, a top view of the stand 32 is shown in FIG. 4B, and an end view of the stand 32 is shown in FIG. 4C. The stand comprises a base 34 which may be a small base fixed to a surface using fasteners passing through mounting holes 38, or the base 34 may also be a larger base providing stable support without fixing to a surface. The stand 32 includes a first positioner 36*a* and a second positioner 36*b*. The base of the spine 16 resides between the positioners 36*a*, 36*b*, and the feet 21 (see FIG. 1A) which hold the plate carrier 10 in a substantially vertical position. The positioner 36*a* includes an upwardly extending extension 40 which resides between the bottom most downward pointing pins 15 (see FIG. 1B) to better support the plate carrier 10. The positioner 36*b* curves away from the positioner 36*a* to facilitate insertion of the base of the spine 16 into the stand 32.

Figure 5A:
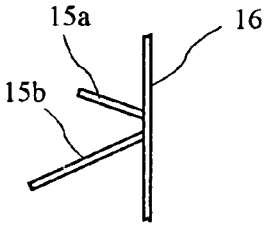
FIG. 5A is a side view of a first alternative plate holder.
Figure 5B:
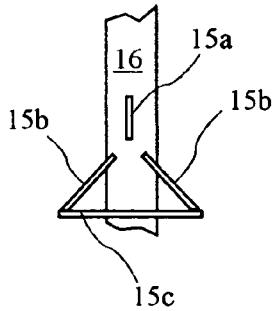
FIG. 5B is a front view of the first alternative plate holder.

A side view of a first alternative plate holder is shown in FIG. 5A, and a front vie the first alternative plate holder is shown in FIG. 5B. The first alternative plate w of holder is similar to the plate holder 18 (see FIGS. 1A and 1B) but includes a horizontal pin 15*c* connecting the lower pins 15*b*.

Figure 5C:
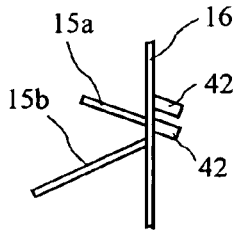
FIG. 5C is a side view of a plate carrier with an adjustable upper pin height.

A side view of a plate carrier with an adjustable upper pin height is shown in FIG. 5C. Pockets 42 are attached to a back side of the spine 16. The pockets have open mouths for insertion of the upper pin 15*a*, and closed ends to hold the pin 15*a*. Two or more pockets 42 are vertically spaced apart on the spine 16 to allow vertical adjustment of the upper pin 15*a* to accommodate various plate sizes.

Figure 6A:
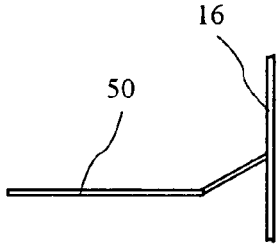
FIG. 6A is a side view of a second alternative plate holder.
Figure 6B:
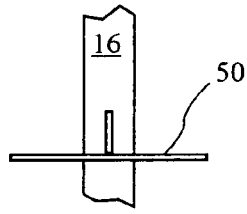
FIG. 6B is a front view of the second alternative plate holder.
Figure 6C:
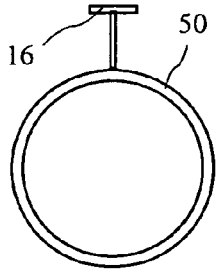
FIG. 6C is a top view of the second alternative plate holder.

A side view of a second alternative plate holder is shown in FIG. 6A, a front view of the second alternative plate holder is shown in FIG. 6B, and a top view of the second alternative plate holder is shown in FIG. 6C. The second alternative plate holder comprises a wire loop 50 is attached to the spine 16, and plates are carried on the wire loop 50.

Figure 7C:
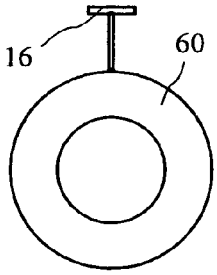
FIG. 7C is a top view of the third alternative plate holder.
Figure 7A:
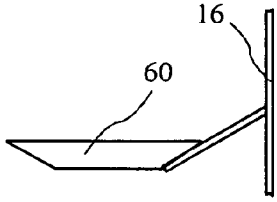
FIG. 7A is a side view of a third alternative plate holder.
Figure 7B:
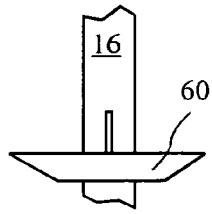
FIG. 7B is a front view of the third alternative plate holder.

A side view of a third alternative plate holder is shown in FIG. 7A, a front view of the third alternative plate holder is shown in FIG. 7B, and a top view of the third alternative plate holder is shown in FIG. 7C. The third alternative plate includes a cup 60 for holding plates. The cup 60 is attached to the spine 16 by an arm 62. The cup 60 resides substantially orthogonal to the spine 16, and is sufficiently close to being orthogonal to carry plates without the plates easily slipping. The cup 60 is preferably dished and may be solid, or include slots, perforations, or the like.

The plate carrier 10 may be made from solid metal or plastic, for example, the spine 16 may be made from metal bar or strap as shown herein, or the plate carrier 10 may be made from a wire form.

While the invention herein disclosed has been described by means of specific embodiments and applications thereof, numerous modifications and variations could be made thereto by those skilled in the art without departing from the scope of the invention set forth in the claims.

I claim:

1. A plate carrier comprising:

a horizontal support having a centerline and including a substantially flat support surface configured for carrying on a forearm of a server with the centerline of the horizontal support aligned with a forearm length $L_F$ of the forearm and having a longitudinal support length $L_S$ parallel to the centerline and a lateral support width $W_S$ perpendicular to the centerline, the support width $W_S$ extending across the forearm while carried;

a spine carried by the horizontal support and extending downward from the horizontal support, the spine including;

a vertical loop portion aligned with the support width $W_S$ and having a loop height $H_L$ and a loop depth $D_L$ and comprising an upper segment residing adjacent to the horizontal support, a center segment laterally displaced from the horizontal support centerline and extending downward from the upper segment, and a lower segment returning perpendicular to the centerline of the horizontal support under the horizontal support allowing the horizontal support to be carried on the forearm with the loop portion looping around the forearm; and a plate holder portion extending down from the lower segment of the loop portion, the plate holder portion approximately laterally centered under the horizontal support by the loop portion; and at least one plate holder extending from the plate holder portion parallel to the centerline of the horizontal support and configured for carrying plates laterally centered under the horizontal support.

2. The plate carrier of claim 1, wherein the support width $W_S$ is between approximately one inch and approximately two inches.

3. The plate carrier of claim 2, wherein the support length $L_S$ is between approximately two inches and approximately twelve inches.

4. The plate carrier of claim 3, wherein the support length $L_S$ is approximately eight inches.

5. The plate carrier of claim 1, wherein;

the support surface has a forward end and a rearward end;

the spine is attached proximal to the rearward end; and the forward end includes an upwardly arched portion to follow a contour of a server's hand.

6. The plate carrier of claim 5, wherein the upwardly arched portion includes a thumb hole.

7. The plate carrier of claim 1, wherein the lower segment of the loop portion returns to approximately a center of the support width $W_S$ of the horizontal support.

8. The plate carrier of claim 1, wherein the horizontal support is made from a flexible or soft material and the plate carrier further includes a horizontally residing support bracket residing against the horizontal support for providing support to the horizontal support.

9. The plate carrier of claim 1, wherein the loop height $H_L$ is approximately 4.5 inches and the loop depth $D_L$ is approximately two inches.

10. The plate carrier of claim 1, wherein the spine further includes a spine upper portion extending upwards from the horizontal support and having at least one plate holder.

11. The plate carrier of claim 1, wherein the at least one plate holder comprises two downward angled pins and one upward angled pin.

12. The plate carrier of claim 11, wherein the downward angled pins are angled downward from the spine and the upward angled pin is angled upward from the spine.

13. The plate carrier of claim 1, wherein the at least one plate holder comprises at least one forward facing plate holder.

14. The plate carrier of claim 1, further including a stand to cooperating with the plate carrier to hold the plate carrier in a substantially vertical position.

15. A plate carrier comprising:

a horizontal support having a longitudinally running centerline CL and substantially rectangular shape, residing horizontally, and having a support length $L_S$ of between approximately two inches and approximately twelve inches along the centerline CL of the horizontal support and support width $W_S$ of between approximately one inch and approximately two inches perpendicular to the centerline CL;

a longitudinally extending horizontal lower support surface of the horizontal support configured for laying against a forearm of a server with the centerline CL of the horizontal support aligned with a length $L_F$ of the forearm;

a spine attached to the horizontal support comprising;

a vertical loop portion residing just below the horizontal support, the loop portion including:

a vertical portion reaching down between approximately four inches and approximately five inches below the horizontal support, from a point offset between approximately 1.5 inches and approximately 2.5 inches laterally from the centerline CL; and a horizontal lower portion reaching under the horizontal support, from the bottom of the vertical portion, a lateral distance between approximately 1.5 inches and approximately 2.5 inches perpendicular to the centerline CL; and a plate holder portion extending down from the loop portion, wherein the plate holder portion is approximately laterally centered under the horizontal support; and at least one plate holder attached to the plate holder portion of the spine and carrying plates laterally centered under the horizontal support.

16. The plate carrier of claim 15, wherein the at least one plate holder comprises at least one plate holder extending in the longitudinal dimension from the plate holder portion.

17. The plate carrier of claim 15, wherein the spine includes an upper portion extending above the horizontal support, wherein a plate holder is attached to the upper portion.

18. The plate carrier of claim 15, wherein;

the horizontal support has a forward end and a rearward end;

the spine is attached proximal to the rearward end; and the forward end includes an upwardly arched portion.

19. A plate carrier comprising:

a horizontal support having a longitudinal centerline CL and a lateral dimension perpendicular to the centerline CL, and including a longitudinally extending horizontal lower support surface configured for laying against a forearm of a server with the centerline CL of the horizontal support aligned with a length $L_F$ of the forearm, the horizontal support having a support length $L_S$ parallel to the centerline CL and a support width $W_S$ perpendicular to the centerline CL, and the support surface extending most of the support length $L_S$ and comprising a lower surface of the horizontal support;

a spine attached to the horizontal support and extending downward from the horizontal support, the spine including:

a vertical loop portion connected to the horizontal support and aligned with the width of the horizontal support and extending downward from the horizontal support for passing beside the forearm of the server and back under the forearm of the server; and a plate holder portion attached to a bottom of the loop portion and extending down from the loop portion, the loop portion positioning the plate holder portion approximately laterally centered under the horizontal support; and at least two vertically spaced apart plate holders attached to the plate holder portion.

20. The plate carrier of claim 19, wherein the horizontal support is made from a flexible or soft material and the plate carrier further includes a horizontally residing support bracket residing against the horizontal support for providing support to the horizontal support.

* * * * *